US007387975B2

(12) United States Patent
Okawa

(10) Patent No.: US 7,387,975 B2
(45) Date of Patent: Jun. 17, 2008

(54) SURFACE FASTENER

(75) Inventor: Mitsuhisa Okawa, Toyama-ken (JP)

(73) Assignee: YKK Corporation, Tokyo (JP)

( * ) Notice: Subject to any disclaimer, the term of this patent is extended or adjusted under 35 U.S.C. 154(b) by 229 days.

(21) Appl. No.: 11/180,201

(22) Filed: Jul. 13, 2005

(65) Prior Publication Data

US 2006/0016506 A1 Jan. 26, 2006

(30) Foreign Application Priority Data

Jul. 20, 2004 (JP) ..... 2004-211187

(51) Int. Cl.
*B32B 5/26* (2006.01)

(52) U.S. Cl. ..... 442/239; 442/203; 442/206; 139/391

(58) Field of Classification Search ..... 442/203, 442/206, 207, 239; 139/391
See application file for complete search history.

(56) References Cited

U.S. PATENT DOCUMENTS 5,349,991 A * 9/1994 Okawa et al. ..... 139/391
5,454,404 A * 10/1995 Okawa ..... 139/54
5,659,930 A * 8/1997 Okawa ..... 24/445
6,357,487 B2 * 3/2002 Okawa ..... 139/410

FOREIGN PATENT DOCUMENTS

JP A-11-244010 9/1999

* cited by examiner

*Primary Examiner*—Andrew T Piziali
(74) *Attorney, Agent, or Firm*—Alston & Bird LLP

(57) ABSTRACT

This invention provides a surface fastener formed of a warp backed woven fabric comprised of a front base fabric and a rear base fabric, an engaging element yarn for forming an engaging element being woven into one or both of the front and rear base fabrics, an engaging portion being formed so that the engaging element projects on the surface of the front base fabric, a warp yarn on a non-engaging portion at a selvage portion is woven by leno weaving structure so that fluffy phenomenon is prevented from being generated on the surface of the non-engaging portion.

9 Claims, 7 Drawing Sheets

SURFACE FASTENER

BACKGROUND OF THE INVENTION

1. Field of the Invention

The present invention relates to a surface fastener which is formed from a base fabric not requiring back-coating of thermoplastic resin on its rear face, and is formed from a beautiful base fabric having a stabilized configuration whose surface is not fluffy.

2. Description of the Related Art

Conventionally, according to Japanese Patent Laid-Open Publication No. 11-244010, as a surface fastener, there has been well known a surface fastener which adopts the back-coating method of fixing engaging element yarns by coating the entire rear surface of the base fabric with polyester base resin or polyurethane base resin in order to finish a robust surface fastener by weaving the engaging element yarns into the base fabric woven with warp yarns and weft yarns, so that the engaging element yarns are fixed firmly on the base fabric.

Further, according to Japanese Patent Laid-Open Publication No. 2001-309805, there has been well known another surface fastener in which the engaging element yarns for forming the engaging element of the surface fastener are woven into the warp backed woven base fabric comprised of front base fabric and rear base fabric, so that the engaging element yarns are implanted such that the engaging elements project from the woven surface and then, a heat melting yarn having a melting point lower than that of such composition yarns as warp yarn, weft yarn, engaging element yarn and connecting yarn is woven between the front base fabric and rear base fabric, while as the composition yarn, nylon 66 fiber is used and as the heat melting yarn, nylon 6 fiber is used, and after weaving, the heat melting yarns are melted by heat so as to fuse the front base fabric together with the rear base fabric.

Because in a surface fastener in which the rear face of its base fabric is coated, the entire rear face of its woven base fabric is coated with such resin as polyester base resin and polyurethane base resin, the entire rear face of the surface fastener hardens so that tactile feeling becomes poor and plasticity of a product is likely to be lost.

Although in the surface fastener in which the front base fabric and the rear base fabric are fused together by heat melting yarns having a low melting point, woven between the front base fabric and the rear base fabric, while engaging element yarn is woven into the base fabric of a warp backed fabric comprised of the front base fabric and the rear base fabric with engaging elements being implanted in the surface of the front base fabric, the root of the engaging element can be fixed to the base fabric firmly, the non-engaging portion such as the selvage portion having no engaging elements, which are formed on the surface of the front base fabric, become fluffy due to other things or the hook-like engaging elements, so that the appearance becomes poor and the engagement function may be lowered.

The present invention has been achieved in consideration of the above-described problems and a prominent object of the present invention is to provide a surface fastener comprised of the warp backed fabric comprised of front base fabric and rear base fabric in which an engaging portion and a non-engaging portion exist on the surface of the base fabric, thereby preventing the warp yarns in the non-engaging portion from being fluffy to ensure an excellent appearance and engagement function and securing a high plasticity.

Another object of the present invention is to provide a surface fastener in which the non-engaging portion having no engaging elements, which exist on the surface of the basic fabric, is defined and the non-engaging portion is prevented from being fluffy by means of leno weaving yarn.

Another object of the present invention is to provide a surface fastener in which the leno weaving yarn is disposed at a position of the warp yarn which can be expected to produce an effect and arranged on both the front base fabric and the rear base fabric or on only the front base fabric in order to exert a function for preventing the surface of the surface fastener from being fluffy effectively.

Another object of the present invention is to provide a surface fastener in which the non-engaging portion having the fluffiness preventing mechanism for the warp yarn is defined in the base fabric on a side implanted with the loop-like engaging elements thereby exerting an excellent fluffiness preventing function.

Still another object of the present invention is to provide a surface fastener in which material of the leno weaving yarn is specified to prevent the leno weaving yarn itself from being fluffy.

Another object of the present invention is to provide a surface fastener formed of a warp backed fabric comprised of a simple weaving structure and having soft tactile feeling and excellent appearance.

SUMMARY OF THE INVENTION

To achieve the above objects, according to the main aspect of the present invention, there is provided a surface fastener being characterized in that an engaging element yarn for forming an engaging element of the surface fastener is woven into one or both of a front base fabric and a rear base fabric of a warp backed woven fabric, so as to form an engaging portion with the engaging element projecting from a surface of a woven fabric, a non-engaging portion without having an engaging element yarn is formed, and a warp yarn of the non-engaging portion is woven by leno weaving structure.

Preferably, a heat melting yarn having a melting point lower than that of the warp yarn, a weft yarn, the engaging element yarn and a leno weaving yarn is woven between the front base fabric and the rear base fabric and melted by heat so as to fuse the front base fabric and the rear base fabric together.

Because the surface of the non-engaging portion having no engaging element formed on the base fabric is prevented from being fluffy, an excellent appearance is secured. Because the root of the engaging element can be fixed to the base fabric firmly, the engagement function can be improved. Further, because the rear face of the surface fastener is not coated with resin, a surface fastener having plasticity, excellent tactile feeling and high quality can be finished.

Preferably, the leno weaving yarn is disposed on the non-engaging portion formed between the engaging elements disposed in a longitudinal direction of the front and rear base fabrics.

Preferably, the leno weaving yarn is disposed on the non-engaging portion of a selvage portion formed on both sides of the front and rear base fabrics in a longitudinal direction thereof.

As a consequence, the non-engaging portion having no engaging elements arranged in the longitudinal direction thereof or the non-engaging portion on the selvage portion having no engaging element on both sides in the longitudinal direction thereof can be prevented from being fluffy, thereby finishing a surface fastener having an excellent appearance.

Preferably, of two warp yarns disposed on the front base fabric, the leno weaving yarn is provided to stride over from side to side to suppress an intermediate portion of an exposed portion of one warp yarn and an intersection portion between the other warp yarn and weft yarns, which are adjacent to each other on front and rear sides, in conditions in which the leno weaving yarn is woven so as to stride over one weft yarn on the front base fabric, to submerge below another weft yarn on the next rear base fabric and to catch the weft yarn.

Consequently, the leno weaving yarn is woven across the front base fabric and rear base fabric, acting as a connecting yarn for the front base fabric and rear base fabric, so that a robust surface fastener having an excellent appearance can be finished.

Preferably, the leno weaving yarn is provided to stride over from side to side to suppress in the vicinity in which two warp yarns disposed on the front base fabric and weft yarns are intersected on a front face of the weft yarns, in conditions in which the leno weaving yarn is woven so as to catch the weft yarn on the front base fabric.

Consequently, the leno weaving yarn can be disposed only on the front base fabric thereby preventing the non-engaging portion from being fluffy. As a consequence, a surface fastener having an excellent appearance can be produced.

Preferably, the leno weaving yarn is disposed on the front base fabric in which the loop-like engaging element is implanted.

Consequently, the loop-like engaging elements of the surface fastener is protected effectively to ensure a smooth engagement/disengagement operation.

Preferably, the leno weaving yarn is formed of mono-filament of synthetic fiber

Consequently, the leno weaving yarn itself is prevented from being fluffy and the warp yarn can be kept from being fluffy for a long period.

Preferably, the warp yarn is woven so as to stride over three or more weft yarns as a connecting yarn between the front base fabric and the rear base fabric, such that the warp yarn is exposed on a surface of the front base fabric or the rear base fabric.

Consequently, the material for a surface fastener plastic and having an excellent tactile feeling and durable for a long term use can be finished. Thus, the effects which the present invention exerts are very remarkable.

DESCRIPTION OF THE PREFERRED EMBODIMENTS

Hereinafter, preferred embodiments of the present invention will be described in detail with reference to the accompanying drawings.

Figure 1:
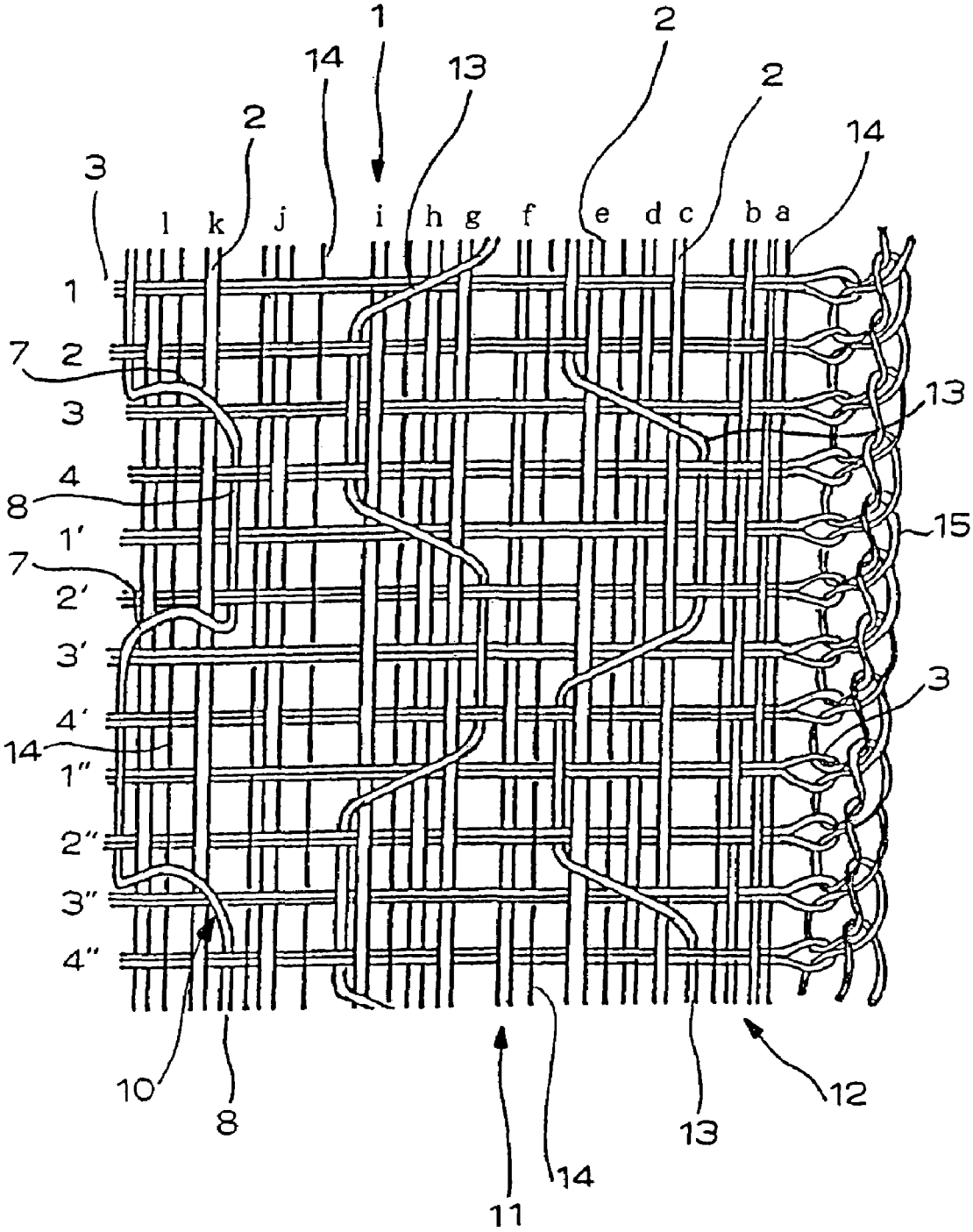
FIG. 1 is a structure diagram of a surface fastener in which a front base fabric and a rear base fabric are woven by leno weaving structure.
Figure 2:
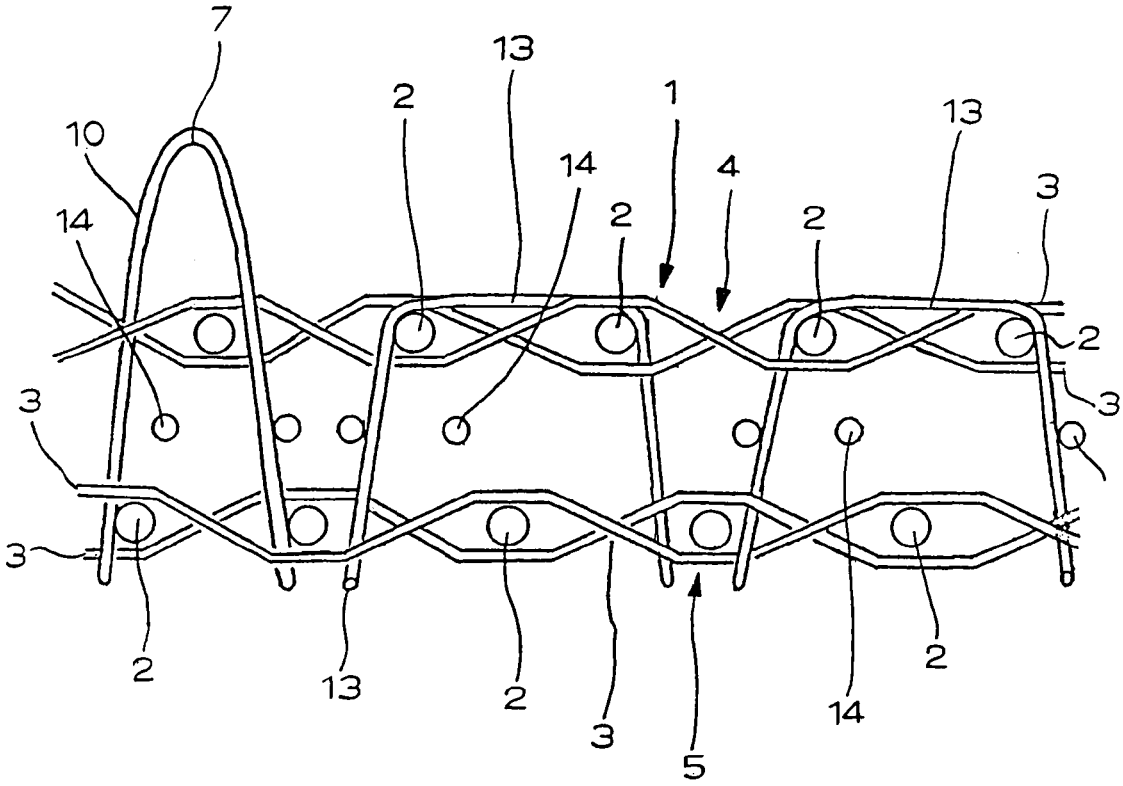
FIG. 2 is a sectional view of the same surface fastener.

As shown in FIGS. 1 and 2, the surface fastener of the present invention is a warp backed woven fabric 1, which is formed on a front base fabric 4 and a rear base fabric 5 woven with a warp yarn 2 and a weft yarn 3, and an engaging element yarn 8 for forming an engaging element 7 of the surface fastener is woven into one or both of the front base fabric 4 and the rear base fabric 5 so as to form an engaging portion 10. The warp backed woven fabric 1 is woven with plain weaving structure by means of a needle loom.

In the surface fastener, the front base fabric 4 and the rear base fabric 5 of the warp backed woven fabric 1 are woven with the warp yarn 2 of synthetic fiber of polyamide base, polyester base or polypropylene base and the weft yarn 3 of double pick of synthetic fiber of the same kind and at the same time, the engaging element yarn 8 for forming the engaging element 7 of the surface fastener is woven to form the engaging portion 10 on the front base fabric 4. In the engaging portion 10, a loop-like engaging element 7 is formed using above described synthetic fiber multi-filament and a hook-like engaging element 7 is formed using the same kind of the synthetic fiber mono-filament.

The engaging portion 10 with the engaging elements 7 and a non-engaging portion 11 without the engaging element 7 are formed on the front base fabric 4. The non-engaging portion 11 is formed at selvage portions 12 on both sides of the base fabrics 4, 5 and between the engaging elements 7 at an appropriate width in the longitudinal direction on the front surface of the base fabrics 4, 5. Plural pieces of warp yarns 2 of the front base fabric 4 in this non-engaging portion 11 are woven by leno weaving structure.

As the leno weaving yarn 13, mono-filament of synthetic fiber is used and as shown in FIG. 1, two warp yarns 2 disposed on the selvage portion 12 of the front base fabric 4, for example, (e) and (c) are woven by leno weaving structure. After the leno weaving yarn 13 intersects the weft yarn 3 (2) on the rear base fabric 5, it is floated over the warp yarns 2(*e*), (*c*), striding over them and after it is intersected with the weft yarn 3(4) on the rear base fabric 5, it is intersected with the weft yarn 3(1') on the front base fabric 4 and the weft yarn 3(2') on the rear base fabric 5. Thereafter, the leno weaving yarn 13 is made to stride over the warp yarns 2(*c*), (*e*), and intersected with the weft yarn 3(4') on the rear base fabric 5. By repeating this weaving structure successively, the leno weaving yarn 13 is woven in. The leno weaving yarn 13 is provided to suppress the intermediate portion of the exposed warp yarn 2(*e*) and intersection portion between the warp yarn 2(*c*) and the weft yarns 3(3), (4), which are adjacent to each other on front and rear sides.

A heat melting yarn 14 of synthetic fiber having a melting point lower than that of the warp yarn 2, the weft yarn 3, the engaging element yarn 8 and the leno weaving yarn 13 is interposed and woven between the woven front base fabric 4 and rear base fabric 5, and after weaving, by melting the heat melting yarn 14 by heat, the front base fabric 4 and the rear base fabric 5 are fused together through their internal faces and part of the melted portion adheres to the inside face of the root of the engaging element 7 and the leno weaving yarn 13, so that the root of the engaging element 7 and the leno weaving yarn 13 are fixed to the front base fabric 4 and rear base fabric 5 firmly.

According to this surface fastener, by weaving some of the warp yarns 2 on the non-engaging portion 11 without any engaging element 7 by leno weaving structure, when the surface fastener is used, by the leno weaving yarn 13, the non-engaging portion 11 is kept from hooking on a mating surface fastener, particularly, a hook-like engaging element 7 or other things so that the warp yarn 2 becomes fluffy thereby leading to drop in surface fastener quality. In the meantime, a single piece of the warp yarn 2 on the non-engaging portion 11, not plural pieces of the warp yarns 2 may be woven by leno weaving structure.

First Embodiment

A surface fastener of this embodiment will be described with reference to FIGS. 1 and 2. As for this surface fastener, a front base fabric 4 and a rear base fabric 5 of a warp backed woven fabric 1 are woven with plain weaving structure by means of a needle loom using a warp yarn 2 formed of multi-filament of such synthetic fiber as polyamide base, polyester base and polypropylene base and a weft yarn 3 of double pick of the same kind of the synthetic fiber. At this time, an engaging element yarn 8 for forming an engaging element 7 of the surface fastener is woven in. When making a loop-like engaging element 7 with the engaging element yarn 8, multi-filament of such synthetic fiber as polyamide base, polyester base and polypropylene base is woven in and napped or brushed to form the loop-like engaging element 7. When making the hook-like engaging element 7, the mono-filament of the same kind of synthetic fiber is woven to form a loop and then by cutting an end of the loop, the hook-like engaging element 7 is formed.

Figure 6:
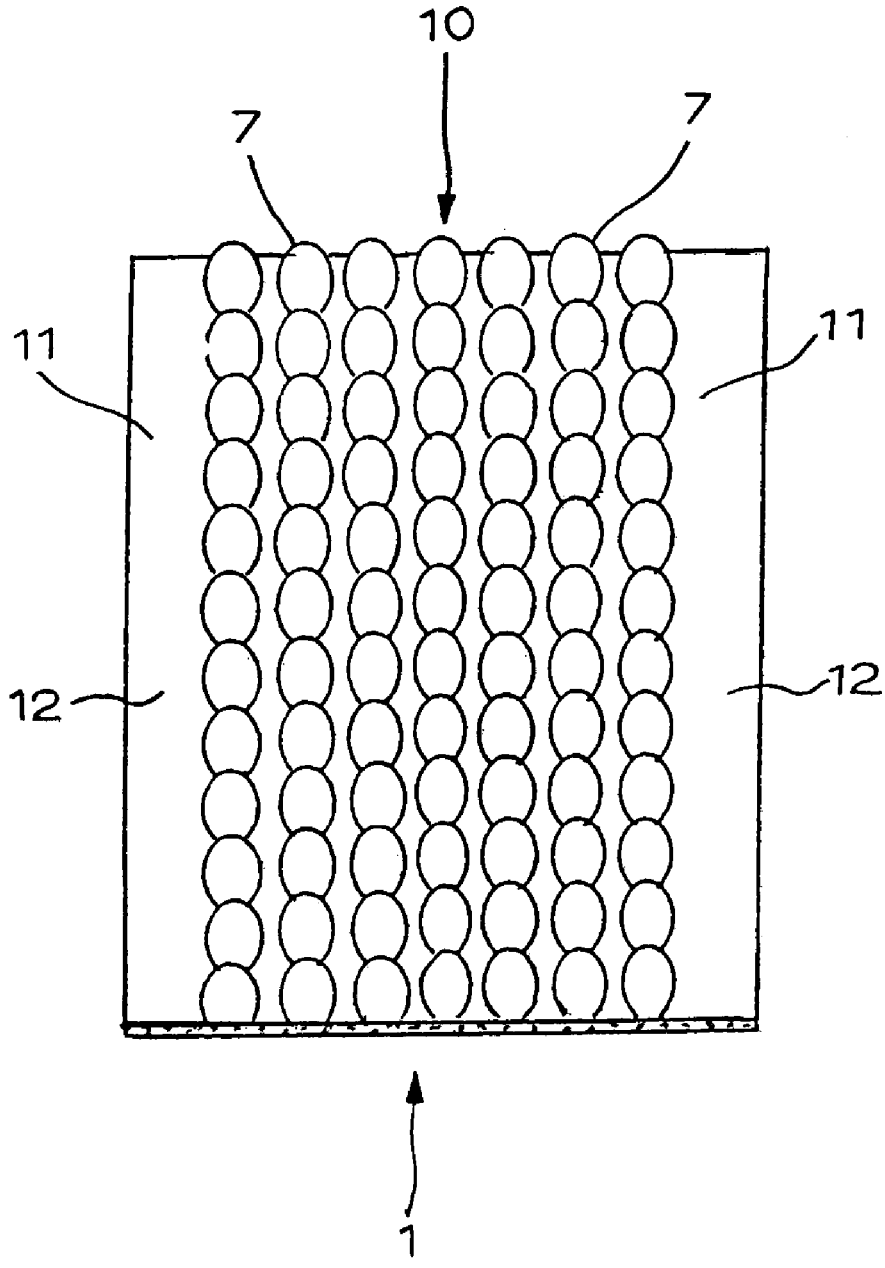
FIG. 6 is a perspective view of a surface fastener having non-engaging portion on both sides.

The engaging element yarn 8 is woven in the shape of loop such that it strides over the warp yarn 2 on the front base fabric 4 and the warp yarn 2 on the rear base fabric 5 every several picks from side to side, so as to form an engaging portion 10 in which the loop portion of the engaging element 7 projects from the surface. A side end of the weft yarn 3 of double pick is woven with a selvage yarn 15 successively so as to form a selvage portion 12. The selvage portion 12 forms a non-engaging portion 11 having no engaging element 7 on both sides of the surface fastener in the shape shown in FIG. 6. Two warp yarns 2(*c*), (*e*) on the non-engaging portion 11 in this selvage portion 12 are woven by leno weaving structure, and the leno weaving yarn 13 is of mono-filament of the same kind of synthetic fiber.

The warp yarns 2(*l*), (*h*), (*d*) and the warp yarns 2(*j*), (*f*) are warp yarns 2 disposed on the rear base fabric 5 and the warp yarns 2(*l*), (*h*), (*d*) submerge below the weft yarn 3(1), stride over the weft yarn 3(2) and further submerge below the weft yarns 3(3), (4), (1') and this procedure is repeated. The warp yarns 2(*j*), (*f*) submerge below the weft yarns 3(1), (2), (3), and stride over the weft yarn 3(4) and this procedure is repeated. Further, the warp yarns 2(*k*), (*g*), (*c*) and the warp yarns 2(*i*), (*e*) are warp yarns disposed on the front base fabric 4. The warp yarns 2(*k*), (*g*), (*c*) stride over the weft yarns 3(1), (2) and submerge below the weft yarn 3(3), and stride over the weft yarn 3(4) and this procedure is repeated. The warp yarns 2(*i*), (*e*) submerge below the weft yarn 3(1) and stride over the weft yarns 3(2), (3), (4) and this procedure is repeated.

As a result of this weaving operation, the warp yarn 2 becomes a connecting yarn for the front base fabric 4 and the rear base fabric 5 so as to weave a warp backed woven fabric. The warp yarns 2(*k*), (*i*), (*g*), (*e*), (*c*) stride over three pieces of the weft yarns 3 on the side of the front base fabric 4 and the warp yarns 2(*l*), (*h*), (*d*), (*j*), (*f*) submerge below three pieces of the weft yarns 3 on the side of the rear base fabric 5.

As for the weaving operation by leno weaving structure, as shown in FIG. 1, after the leno weaving yarn 13 is intersected with the weft yarn 3(2) on the rear base fabric 5, it is made to stride over the weft yarn 3(3) on the front base fabric 4 and the warp yarns 2(*e*), (*c*) and intersected with the weft yarn 3(1') on the front base fabric 4 and the weft yarn 3(2') on the rear base fabric 5. Thereafter, the leno weaving yarn 13 is made to stride over the warp yarns 2(*c*), (*e*) on the front base fabric 4 and the weft yarn 3(3') and then intersected with the weft yarn 3(4') on the rear base fabric 5 and this procedure is repeated. The leno weaving yarn 13 is provided to suppress the intermediate portion of the exposed warp yarn 2(*e*) and intersection portion between the warp yarn 2(*c*) and the weft yarns 3, which are adjacent to each other on front and rear sides.

Further, the warp yarns 2(*g*), (*i*) are woven by leno weaving structure, and the leno weaving yarn 13 is made to stride over the weft yarn 3(1) on the front base fabric 4 and the warp yarns 2(*g*), (*i*) and intersected with the weft yarn 3(2) on the rear base fabric 5 and after that, it is intersected with the weft yarn 3(3) on the front base fabric 4 and the weft yarn 3(4) on the rear base fabric 5. Thereafter, the leno weaving yarn 13 is made to stride over the warp yarns 2(*i*), (*g*) on the front base fabric 4 and the weft yarn 3(1') and intersected with the weft yarn 3(2') on the rear base fabric 5 and this procedure is repeated.

A heat melting yarn 14 of synthetic fiber having a melting point lower than that of the warp yarn 2, the weft yarn 3, the engaging element yarn 8 and the leno weaving yarn 13 is interposed and woven between the woven front base fabric 4 and the rear base fabric 5. For example, polyamide base nylon 66 is used for the warp yarn 2, the weft yarn 3, the engaging element yarn 8 and the leno weaving yarn 13 and nylon 6 fiber is used for the heat melting yarn 14. After the weaving operation, the nylon 6 fiber, which is the heat melting yarn 14, is heated and melted to fuse the front base fabric 4 and the rear base fabric 5 together through their inside faces and part of the melted portion adheres to the root of the engaging element 7 and the leno weaving yarn 13, so that the root of the engaging element 7 and the leno weaving yarn 13 are fixed firmly.

No resin oozes to the surface of the rear base fabric 5, which is a rear face of the surface fastener so that excellent tactile feeling is secured and further, the non-engaging portion 11 is woven by leno weaving structure so that it is kept from hooking on a mating hook-like engaging element 7 or other things. As a result, the surface of the front base fabric 4 is kept from being fluffy by such a processing as brushing. Consequently, a stabilized engaging/disengaging operation is secured for a long term and a surface fastener of excellent quality is obtained.

Figure 7:
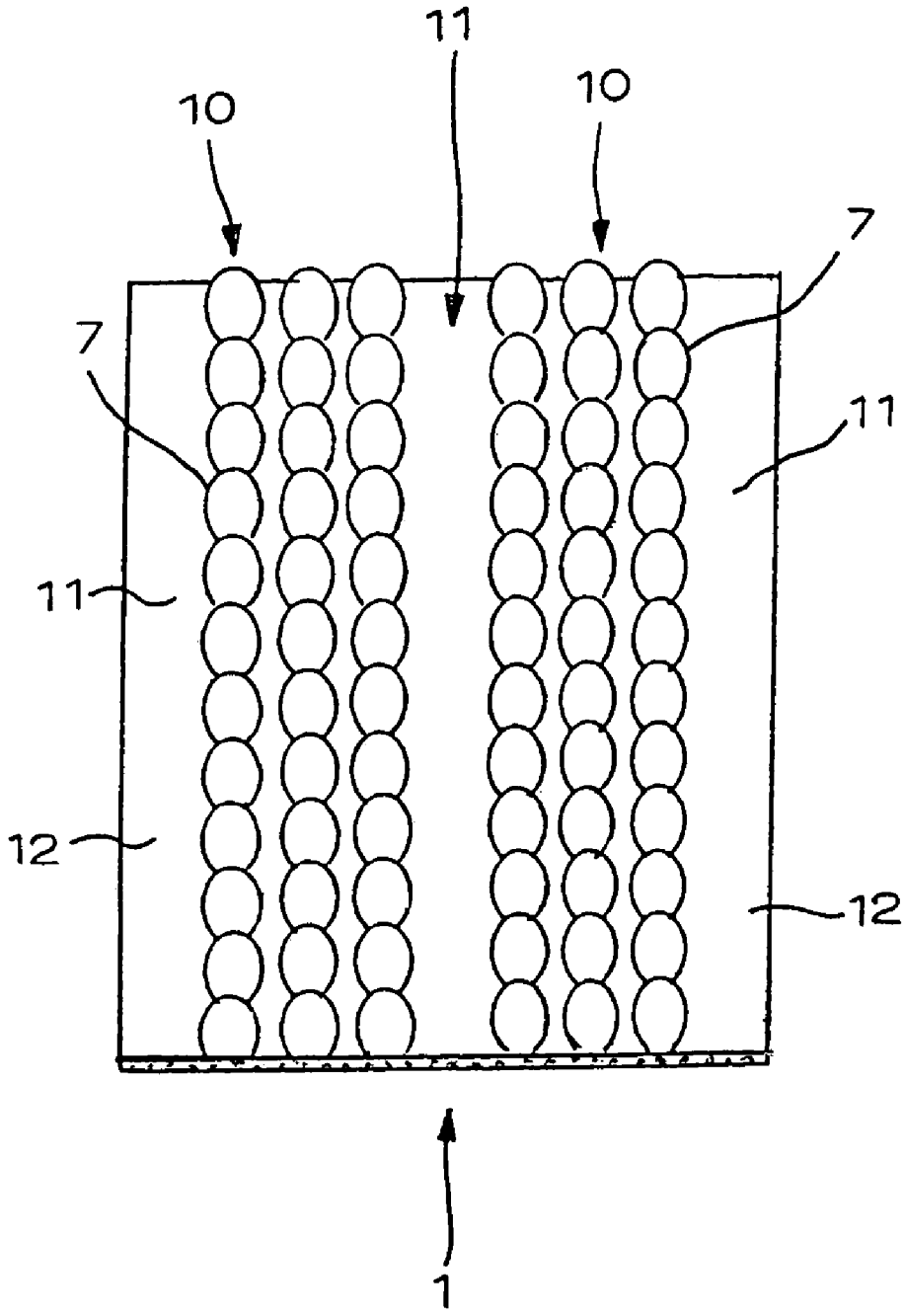
FIG. 7 is a perspective view of a surface fastener having non-engaging portion on both sides and in the center.

The weaving structure of the warp backed woven fabric 1 is not restricted to the plain weaving structure but may be constructed with other structure. As for the non-engaging portion 11 having no engaging element 7 formed on the surface fastener, as shown in FIG. 7, the non-engaging portion 11 is formed in the longitudinal direction in the center of the surface fastener and by weaving the warp yarn 2 of this non-engaging portion 11 by leno weaving structure, the surface of the surface fastener can be prevented from being fluffy.

Second Embodiment

Figure 3:
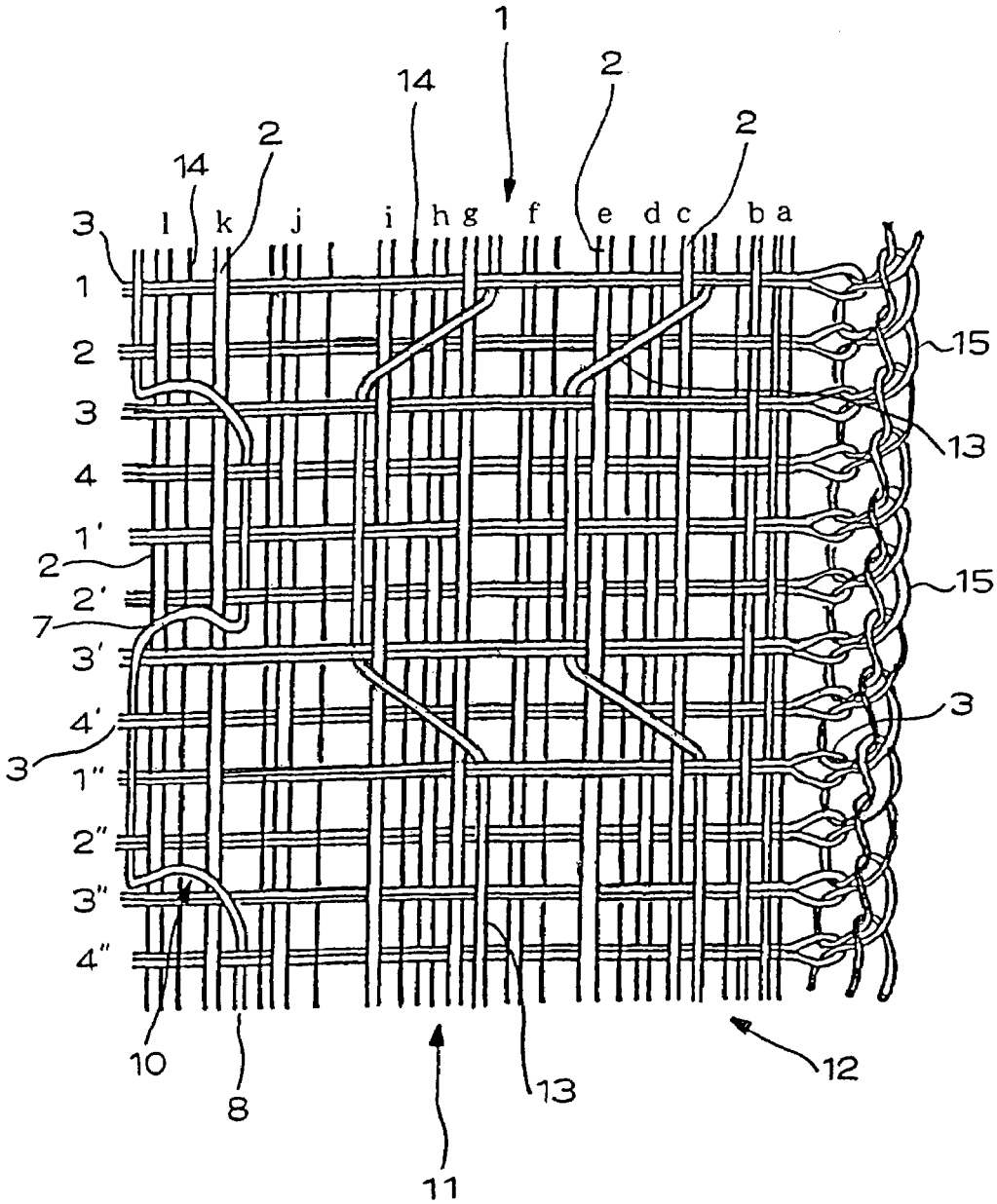
FIG. 3 is a structure diagram of a surface fastener in which only the front base fabric is woven by leno weaving structure.
Figure 4:
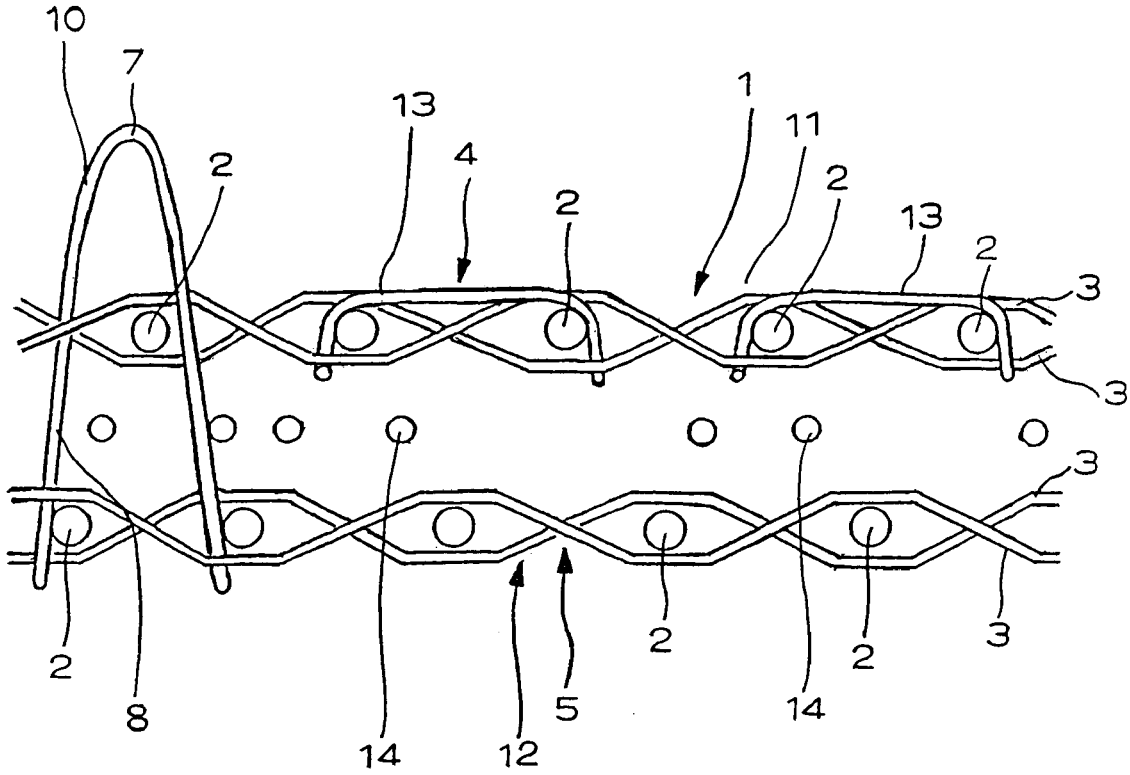
FIG. 4 is a sectional view of the same surface fastener.

The surface fastener of the embodiment shown in FIGS. 3 and 4 is the same as that of the first embodiment in the weaving structure of a front base fabric 4 and a rear base fabric 5 of a warp backed woven fabric 1 and the material of a warp yarn 2, a weft yarn 3, an engaging element yarn 8, a leno weaving yarn 13 and a heat melting yarn 14. A different point exists in the weaving position of the leno weaving yarn 13.

As for the disposition of the leno weaving yarn 13, as shown in FIGS. 3 and 4, the leno weaving yarn 13 is disposed only on the front base fabric 4. For example, after the leno weaving yarn 13 is intersected with the weft yarn 3(1) on the front base fabric 4 as shown in FIG. 3, it is made to stride over the warp yarn 2(*c*) and the warp yarn 2(*e*) and after it is intersected with the weft yarn 3(3) on the front base fabric 4, it is intersected with the weft yarn 3(1'). Next after it is intersected with the weft yarn 3(3'), it is made to stride over the warp yarn 2(*e*) and the warp yarn 2(*c*) and intersected with the weft yarn 3(1") of the front base fabric 4 and this procedure is repeated. As shown in FIG. 4, the leno weaving yarn 13 is disposed only on the front base fabric 4.

The front base fabric 4 and the rear base fabric 5 of the woven warp backed fabric 1 are fused together by melting the heat melting yarn 14 interposed between the front base fabric 4 and the rear base fabric 5 by heat, so that the root of the engaging element 7 and the leno weaving yarn 13 can be fixed on the rear face of the front base fabric 4 firmly.

Third Embodiment

Figure 5:
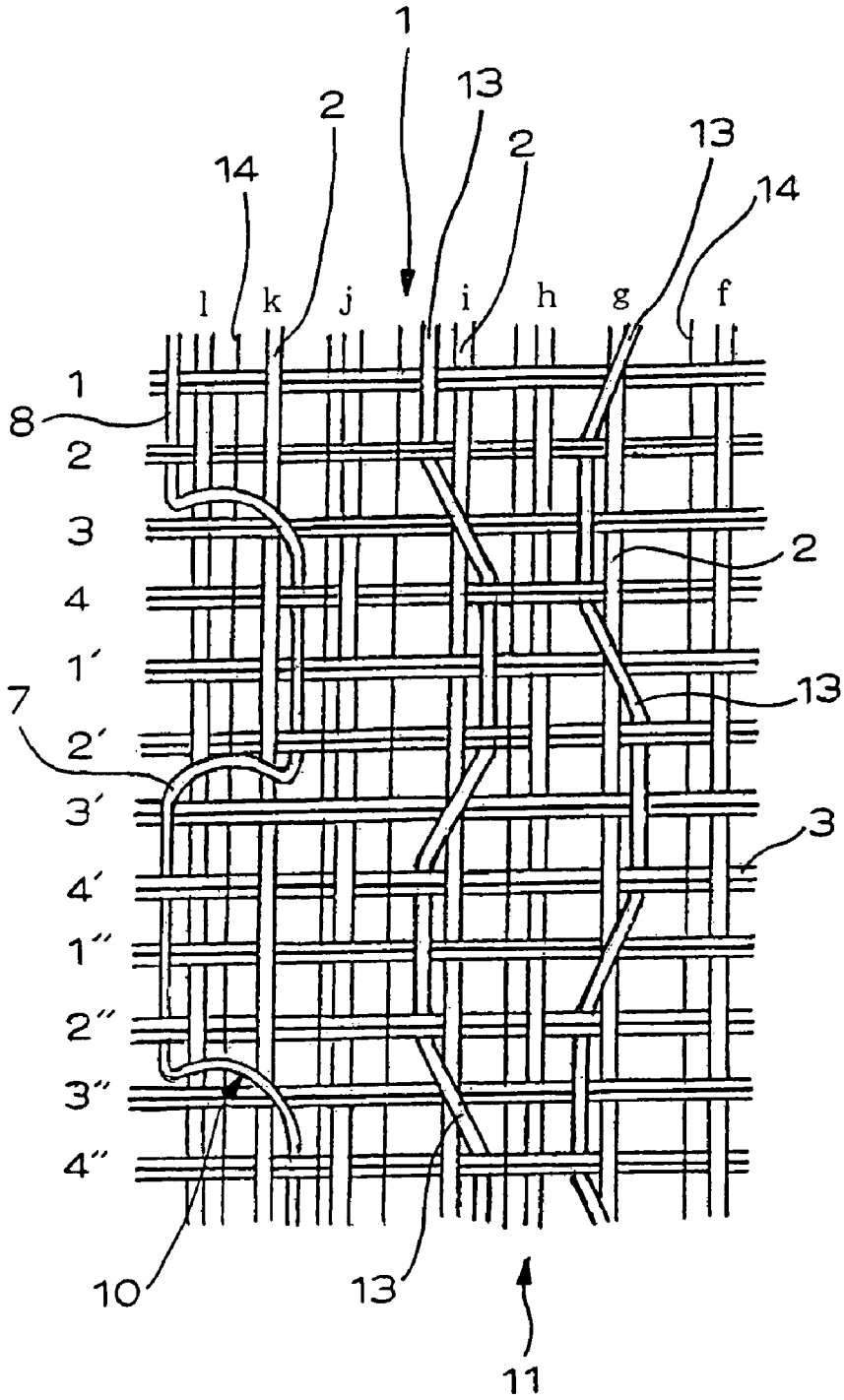
FIG. 5 is a structure diagram of a surface fastener in which a single warp yarn is woven by leno weaving structure.

The surface fastener of the embodiment shown in FIG. 5 is the same as those of the respective embodiments in the weaving structure of a front base fabric 4 and a rear base fabric 5 of a warp backed woven fabric 1 and the material of a warp yarn 2, a weft yarn 3, an engaging element yarn 8, a leno weaving yarn 13 and a heat melting yarn 14. A different point exists in such a configuration in which one piece of the warp yarn 2 disposed on a non-engaging portion 11 of the front base fabric 4 is woven by leno weaving structure.

As shown in FIG. 5, the warp yarns 2(*i*), (*g*) disposed on the non-engaging portion 11 of the front base fabric 4 are woven by leno weaving structure. As regards the warp yarn 2(*i*), the leno weaving yarn 13 is intersected with the weft yarn 3(1) and then, submerges below the weft yarn 3(2). Next, this leno weaving yarn 13 strides over an intermediate portion exposed on the front base fabric 4 of the warp yarn 2(*i*) in the right and left direction to suppress the warp yarn 2 and submerges below the weft yarn 3(4). After it intersects the weft yarn 3(1'), it submerges below the weft yarn 3(2') and next, strides over an intermediate portion exposed on the front base fabric 4 of the warp yarn 2(*i*) in the right and left direction to suppress the warp yarn 2. Then, this leno weaving yarn 13 submerges below the weft yarn 3(4') and intersects the weft yarn 3(1") and then submerges below the weft yarn 3(2"). Next, it strides over the intermediate portion exposed on the front base fabric 4 of the warp yarn 2(*i*) in the right and left direction to suppress the warp yarn 2 and submerges below the weft yarn 3(4"). After this, this procedure is repeated.

The leno weaving yarn 13 to the warp yarn 2(*g*) strides over the intermediate portion exposed on the front base fabric 4 of the warp yarn 2(*g*) in the right and left direction to suppress the warp yarn 2 and then submerges below the weft yarn 3(2). Next, it intersects the weft yarn 3(3) and submerges below the weft yarn 3(4). Next, the leno weaving yarn 13 strides over the intermediate portion exposed on the front base fabric 4 of the warp yarn 2(*g*) in the right and left direction to suppress the warp yarn 2 and submerges below the weft yarn 3(2'). Then, it intersects the weft yarn 3(3') and submerges below the weft yarn 3(4') and next, strides over the intermediate portion exposed on the front base fabric 4 of the warp yarn 2(*g*) in the right and left direction to suppress the warp yarn 2 and submerges below the weft yarn 3(2"). This leno weaving yarn 13 intersects the weft yarn 3(3") and submerges below the weft yarn 3(4"). This procedure is repeated to weave the surface fastener. As described above, one warp yarn 2 disposed on the non-engaging portion 11 of the front base fabric 4 is woven by leno weaving structure so as to prevent the warp yarns 2 on the non-engaging portion 11 from being fluffy.

Because the surface fastener of the present invention has plasticity, providing an excellent tactile feeling, this can be attached preferably to an opening portion in clothing, bag and sack, particularly underwear, pajama, and diaper cover which make direct contact with the skin.

What is claimed is:

1. A surface fastener wherein an engaging element yarn for forming an engaging element of the surface fastener is woven into one or both of a front base fabric and a rear base fabric of a warp backed woven fabric, so as to form an engaging portion with the engaging element projecting from a surface of a woven fabric, a non-engaging portion without having an engaging element yarn is formed, and the non-engaging portion is woven by leno weaving structure, in which a leno weaving yarn repeats to stride over one or more adjacent warp yarn on the front base fabric and intersect with one or more weft yarn on the rear base fabric in a warp direction, and thereafter, to stride over the same warp yarn on the front fabric and intersect with one or more following weft yarn on the rear base fabric in a warp direction.

2. The surface fastener according to claim 1, wherein a heat melting yarn having a melting point lower than that of the warp yarn, a weft yarn, the engaging element yarn and a leno weaving yarn is woven between the front base fabric and the rear base fabric and melted by heat so as to fuse the front base fabric and the rear base fabric together.

3. The surface fastener according to claim 1, wherein the leno weaving yarn is disposed on the non-engaging portion formed between the engaging elements disposed in a longitudinal direction of the front and rear base fabrics.

4. The surface fastener according to claim 1, wherein the leno weaving yarn is disposed on the non-engaging portion of a selvage portion formed on both sides of the front and rear base fabrics in a longitudinal direction thereof.

5. The surface fastener according to claim 1, wherein, of two warp yarns disposed on the front base fabric, the leno weaving yarn is provided to stride over from side to side to suppress an intermediate portion of an exposed portion of one warp yarn and an intersection portion between the other warp yarn and weft yarns, which are adjacent to each other on front and rear sides, in conditions in which the leno weaving yarn is woven so as to stride over one weft yarn on the front base fabric, to submerge below another weft yarn on the next rear base fabric and to catch the weft yarn.

6. The surface fastener according to claim 1, wherein the leno weaving yarn is provided to stride over from side to side to suppress in the vicinity in which two warp yarns disposed on the front base fabric and weft yarns are intersected on a front face of the weft yarns, in conditions in which the leno weaving yarn is woven so as to catch the weft yarn on the front base fabric.

7. The surface fastener according to claim 1, wherein the leno weaving yarn is disposed on the front base fabric in which the loop-like engaging element is implanted.

8. The surface fastener according to claim 1, wherein the leno weaving yarn is formed of mono-filament of synthetic fiber.

9. The surface fastener according to claim 1, wherein the leno weaving yarn is woven so as to stride over three or more weft yarns as a connecting yarn between the front base fabric and the rear base fabric, such that the warp yarn is exposed on a surface of the front base fabric or the rear base fabric.

* * * * *